US010082366B2

(12) United States Patent
Newzella

(10) Patent No.: US 10,082,366 B2
(45) Date of Patent: Sep. 25, 2018

(54) FIRE-CONTROL DEVICE FOR A SMALL ARM AND SMALL ARM

(71) Applicant: MBDA Deutschland GmbH, Schrobenhausen (DE)

(72) Inventor: Alfons Newzella, Alling (DE)

(73) Assignee: MBDA Deutschland GmbH, Schrobenhausen (DE)

( * ) Notice: Subject to any disclaimer, the term of this patent is extended or adjusted under 35 U.S.C. 154(b) by 0 days.

(21) Appl. No.: 15/268,320

(22) Filed: Sep. 16, 2016

(65) Prior Publication Data

US 2017/0227328 A1 Aug. 10, 2017

(30) Foreign Application Priority Data

Sep. 19, 2015 (DE) ..... 10 2015 012 206

(51) Int. Cl.

| | |
|---|---|
| ***F41A 15/00*** | (2006.01) |
| ***F41G 3/08*** | (2006.01) |
| ***F41C 27/06*** | (2006.01) |
| ***F41G 3/06*** | (2006.01) |

(52) U.S. Cl.
CPC ..... *F41G 3/08* (2013.01); *F41C 27/06* (2013.01); *F41G 3/06* (2013.01)

(58) Field of Classification Search
CPC ... F41G 3/06; F41G 3/065; F41G 3/08; F41G 3/14; F41G 3/16; F41G 5/00
USPC ..... 42/111
See application file for complete search history.

(56) References Cited

U.S. PATENT DOCUMENTS

| | | | | |
|---|---|---|---|---|
| 5,171,933 | A | 12/1992 | Eldering | |
| 5,686,690 | A | 11/1997 | Lougheed et al. | |
| 6,202,535 | B1 * | 3/2001 | Alhadef | F41G 3/02 89/41.09 |
| 6,499,382 | B1 | 12/2002 | Lougheed et al. | |
| 6,829,858 | B2 * | 12/2004 | Gablowski | F41C 27/06 42/105 |
| 7,549,367 | B2 * | 6/2009 | Hill | F41A 27/30 89/136 |
| 7,806,331 | B2 * | 10/2010 | Windauer | F41G 1/38 235/404 |
| 8,322,269 | B2 * | 12/2012 | Sullivan | F41A 27/14 89/41.11 |

(Continued)

FOREIGN PATENT DOCUMENTS

| | | |
|---|---|---|
| EP | 0785406 A2 | 7/1997 |
| WO | 2015102707 | 9/2015 |

OTHER PUBLICATIONS

Office action dated Dec. 15, 2016 from corresponding German Patent Application.

(Continued)

*Primary Examiner* — J. Woodrow Eldred
(74) *Attorney, Agent, or Firm* — Greer, Burns & Crain, Ltd.

(57) ABSTRACT

A fire-control device for a small arm includes an inertial sensor unit for six degrees of freedom, a distance sensor for determining a distance to a target sighted via a sight, and a computation device for determining a target orientation of the small arm from the distance so as to be able to hit the target, the computation device being set up to detect a change in position of the small arm by way of the inertial sensor unit and to correct the target orientation using data from the inertial sensor unit.

14 Claims, 3 Drawing Sheets

(56) References Cited

U.S. PATENT DOCUMENTS

| | | | | |
|---|---|---|---|---|
| 8,336,776 | B2 | 12/2012 | Horvath et al. | |
| 8,468,930 | B1 | 6/2013 | Bell | |
| 2011/0162250 | A1* | 7/2011 | Windauer | F41G 1/38 42/119 |
| 2012/0097741 | A1 | 4/2012 | Karcher | |
| 2014/0283429 | A1* | 9/2014 | Sullivan | F41G 11/003 42/111 |
| 2015/0041538 | A1 | 2/2015 | Teetzel et al. | |
| 2015/0068098 | A1 | 3/2015 | Stokes et al. | |
| 2015/0108215 | A1 | 4/2015 | Ehrlich | |
| 2016/0025455 | A1* | 1/2016 | Paterson | F41G 3/06 42/122 |
| 2016/0169621 | A1* | 6/2016 | Geva | F41G 1/40 42/118 |
| 2016/0216071 | A1* | 7/2016 | Bernard | F41G 1/393 |
| 2017/0097209 | A1* | 4/2017 | Portoghese | F41G 3/2605 |

OTHER PUBLICATIONS

Search Report from Corresponding European Patent Application, dated Mar. 8, 2017.

* cited by examiner

FIRE-CONTROL DEVICE FOR A SMALL ARM AND SMALL ARM

CROSS REFERENCE TO RELATED APPLICATIONS

This application claims priority to German Patent Application No. 10 2015 012 206.1 filed on Sep. 19, 2015, the entirety of which is incorporated herein by reference.

FIELD OF THE INVENTION

The present invention relates to a fire-control device for a small arm. The invention further relates to a small arm comprising a fire-control device of this type.

BACKGROUND OF THE INVENTION

Sighting aids and fire-control computers for rifle-mounted grenade launchers and for heavy portable support weapons are known in the art. Sighting aids and fire-control computers in the art have inclination sensors and optionally a gyroscope in the horizontal plane to improve the accuracy of fire. By means of the sensors, the orientation of the weapon with respect to the target, the superelevation and in particular a deflection can be detected by measurement, and information for the marksman can be generated. Further sensors serve to determine the target distance or to make it possible to predict the trajectory of the grenade better on the basis of physical constraints such as air pressure, temperature, wind or the like. Systems of this type are disclosed for example in EP 0 785 406 A2 and U.S. Pat. No. 6,499,382 B1.

A drawback of the available portable systems is that a marksman, even when firing ballistic ammunition at a large superelevation, may no longer move or leave his position after sighting and calibrating the target until he has taken the shot. The marksman therefore has to remain in his potentially exposed position until he has taken the shot. Only subsequently can the marksman again take on a safe position, for example behind cover.

SUMMARY OF THE INVENTION

One of the ideas of the present invention is to provide a fire-control device for a small arm which, in addition to simple and cost-effective manufacture and assembly, makes safe and reliable hitting of a target possible, a marksman who is operating the small arm simultaneously being protected as well as possible.

A fire-control device for a small arm, comprises an inertial sensor unit, a distance sensor and a computation device. The inertial sensor unit is formed in particular for six degrees of freedom. Thus, in particular three translational and three rotational degrees of freedom can be detected by the inertial sensor unit. The distance sensor is formed in particular to determine a distance to a target sighted via a sight. The sight may in particular be a sight of the small arm or a sight inherent to the fire-control device. In particular, it is provided that the distance to a target of this type which is sighted by the sight can be determined. Thus, the distance sensor may be synchronised with any desired sight, in such a way that the fire-control device is suitable for various sighting systems of the small arm. The computation device is advantageously formed to calculate a target orientation of the small arm from the distance, which can be determined by the distance sensor. The target orientation is an orientation of the small arm such as is required so as to be able to hit the target. Further, the computation device is set up to detect a change in position of the small arm by way of the inertial sensor unit and to correct the target orientation using data from the inertial sensor unit. This makes it possible for the marksman, after sighting the target, to change his position, the fire-control device taking the change in position into account in the target orientation of the small arm. The marksman can therefore take a shot from a safe position, and still has the assistance of the fire-control device, which by way of the target orientation gives him an indication as to how the marksman should optimally orientate his small arm. In summary, the invention makes it possible to overcome the aforementioned drawbacks, by making it possible for the marksman to make a change in position after calibrating the target and before the marksman takes the shot and to take further shots at the target without recalibration.

Advantageously, the inertial sensor unit may in some embodiments have three acceleration sensors and three rotation rate sensors. Thus, any movement in three-dimensional space can be detected by the inertial sensor unit. The rotation rate sensors are advantageously gyroscopic sensors.

The computation device may in some embodiments be set up to determine a target elevation angle of the small arm from the distance, which can be determined by the distance sensor, and from parameters, predefined in a storage unit, of a projectile to be fired by the small arm. The target elevation angle is in particular an angle through which the barrel of the small arm has to be pivoted from the horizontal such that the projectile fireable from the small arm can hit the target in accordance with a ballistic trajectory. For this purpose, physical parameters of the projectile are predefined in the storage unit. Thus, the target elevation angle can be calculated in a very simple manner from the distance and the predefined parameters. It is further provided that, after a change in position of the small arm, the distance and thus also the target elevation angle can be corrected by the computation device using data from the inertial sensor unit. Thus, a new measurement of the distance by the distance sensor is not necessary, meaning that the change in position may even result in the marksman and thus the distance sensor not having a direct line of sight to the target. A new measurement of the distance by the distance sensor would not be possible in this case. As a result of the determination of the change in distance using the data from the inertial sensor unit, this problem can easily be solved, in such a way that, after initially sighting the target, the marksman can change his position, in particular to seek cover. This significantly increases the safety of the marksman.

Particularly advantageously, the computation device may in some embodiments be set up additionally to determine the target elevation angle using data from an air pressure sensor and/or an air humidity sensor and/or a temperature sensor. The air pressure, the air humidity and the temperature have an effect on the trajectory of the projectile, and so determining the current values for air pressure, air humidity and temperature can improve the target orientation, in particular the target elevation angle.

In some embodiments of the fire-control device, the computation device is set up to determine a target azimuth angle from a current orientation of the small arm, which can be determined from data from the inertial sensor unit. In particular, the computation device may be set up to initialise the inertial sensor unit when the marksman sights a target. The target azimuth angle is thus advantageously based on any deviation of the small arm in the azimuth direction from the initialisation position. Further, it is advantageously provided that, after a change in position of the small arm or after a change in the current orientation of the small arm, the target azimuth angle can be corrected using data from the inertial sensor unit, and in particular the change in position relative to the target calculated from said data. Thus, a direction to the target is always available to the marksman, and so the marksman can orientate his small arm, at least in the azimuth direction, even without line of sight to the target.

Particularly advantageously, the computation device may in some embodiments be set up additionally to determine a current orientation of the small arm from data from at least one magnetic sensor, in particular from three magnetic sensors. In particular, using the magnetic sensors, a terrestrial magnetic field can be calculated, in such a way that the magnetic sensors have a compass functionality. Therefore, a change in the orientation of the small arm can also be detected using the magnetic sensors. Advantageously, it is provided that the magnetic sensors are subordinate to the inertial sensor unit, in such a way that the data from the inertial sensor unit are prioritised in the event of contradiction between data from the inertial sensor unit and the magnetic sensor unit. In this way, the fire-control device cannot be affected by metal items or magnetic interference devices.

In some embodiments, the fire-control device has a user input device. The user input device may in particular be a push-button. For this purpose, the computation device is advantageously set up to determine, after a user input, the distance to the sighted target using the distance sensor. The computation device is further set up to determine, after a user input, an assumed movement of the target from a movement of the small arm determined from data from the inertial sensor device. In particular, it is provided that the data from the inertial sensor unit are detected as long as the user holds the push-button down. Once the marksman is no longer holding the push-button down, the computation device calculates an assumed movement of the target from the determined movement of the small arm. If no assumed movement of the target can be determined, it is in particular provided that the computation device outputs an error message. Determining the assumed movement of the target makes it simpler for the marksman to determine a deflection angle. Thus, the hit probability is increased.

The distance sensor is advantageously a laser distance sensor. Using a laser distance sensor, distances can be determined in a simple, rapid and reliable manner. Meanwhile, a laser distance sensor is very robust with respect to environmental influences.

Finally, the fire-control device advantageously has a display device. By way of the display device, in particular the target orientation, advantageously the target elevation angle and the target azimuth angle, and/or a current deviation of the small arm from the target orientation, in particular from the target azimuth angle and from the target elevation angle, can be displayed. Advantageously, further parameters can be displayed such as in particular the assumed movement direction of the target. Thus, comprehensive information is available to the marksman so as to be able to hit the target safely and reliably.

Finally, the invention relates to a small arm. The small arm may in some embodiments be an assault rifle comprising an under-barrel grenade launcher or a portable grenade launcher or a grenade gun. Advantageously, the small arm, in particular the assault rifle, has a fire-control device, as described above. Thus, the combat value of the small arm is greatly increased, since it is made possible for the marksman of the small arm, after acquiring a target, to change his position so as subsequently to be able to hit the target. The fire-control device according to the invention also makes it possible to reload the weapon and hit the target again without the target having to be acquired again.

Additional aspects, embodiments, and details of the invention, all of which may be combinable in any manner, are set forth in the following detailed description of the invention.

BRIEF DESCRIPTION OF THE DRAWINGS

The invention is now described in detail by way of an embodiment with reference to the accompanying drawings, in which.

DETAILED DESCRIPTION OF EMBODIMENTS OF THE INVENTION

One or more embodiments of the present invention will be described with the understanding that the following description is not intended to be limiting.

Figure 1:
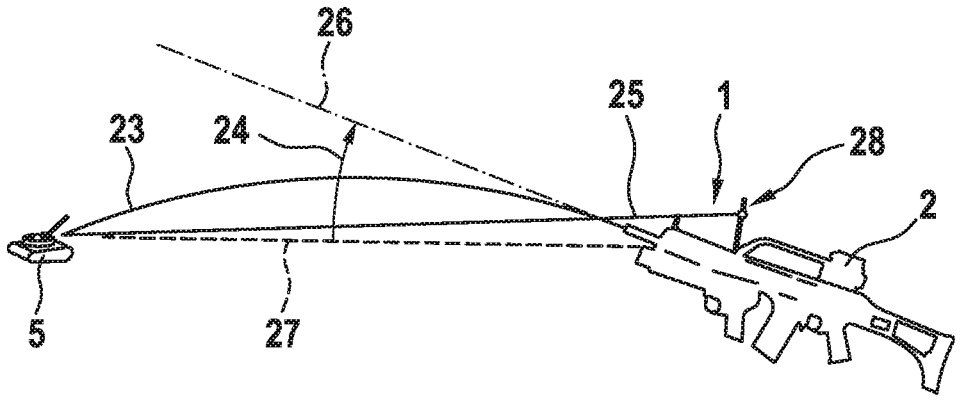
FIG. 1 is a schematic drawing of a small arm comprising a fire-control device in accordance with an embodiment of the invention in a side view.
Figure 2:
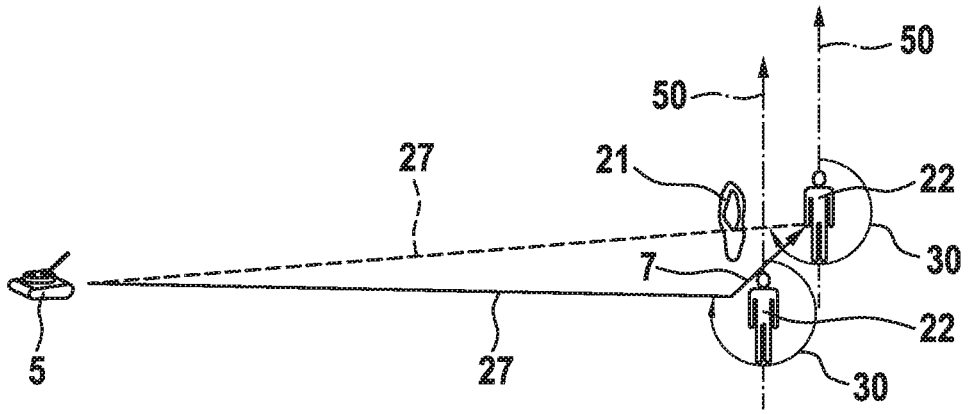
FIG. 2 is a schematic drawing of the small arm comprising the fire-control device in accordance with the embodiment of the invention in a plan view.

FIG. 1 schematically shows a small arm 2 comprising a fire-control device 1 in accordance with an embodiment of the invention. In FIG. 1, a side view is selected. FIG. 2 is a plan view of the scenario shown in FIG. 1.

The small arm 2 is operated by a marksman 22, who wishes to hit a target 5. By way of a sight 28, the marksman can sight the target 5, in such a way that the target 5 is in a sightline 25 of the sight 28. In the example shown in FIG. 1, the sight 28 is a sight of the fire-control device 1. Alternatively, the sight 28 may also be a sight of the small arm 2. In either case, a distance sensor 4 of the fire-control device 1 is configured to determine a distance 27 from the target 5 when the target 5 is located within the sightline 25. The small arm is in particular an assault rifle comprising an under-barrel grenade launcher or a portable grenade launcher or a grenade gun.

So as to be able to hit the target 5, the marksman 22 has to orientate the small arm 2 in such a way that there is a positive elevation angle 24. The elevation angle 24 is the angle between the line directly connecting the small arm 2 to the target 5 and the barrel axis 26 passing centrally through a barrel of the small arm 2. At a correctly set elevation angle 24, a projectile fired by the small arm 2 follows a ballistic trajectory 23 and hits the target 5 at the end of the trajectory 23.

It is known in the art that an associated elevation angle 24 can be calculated from the distance 27. Likewise, an azimuth angle 30, 31 can be determined with respect to the northward direction 50. However, as is shown in FIG. 2, the distance 27 may change if the marksman 22 makes a change in position 7. The change in position 7 may also cause a first azimuth angle 31 before the change in position 7 to differ from a second azimuth angle 30 after the change in position 7. In fire-control devices in the art, the marksman 22 has to remain at an exposed location, at which both the marksman 22 and the fire-control device 1 have line of vision to the target 5. The fire-control device 1 according to the invention makes the change in position 7 possible for the marksman 22, in such a way that the marksman 22 can seek protection behind cover 21. A target orientation of the small arm 2 in azimuth and elevation is thus adapted to the distance 27 which has changed as a result of the change in position 7.

Figure 3:
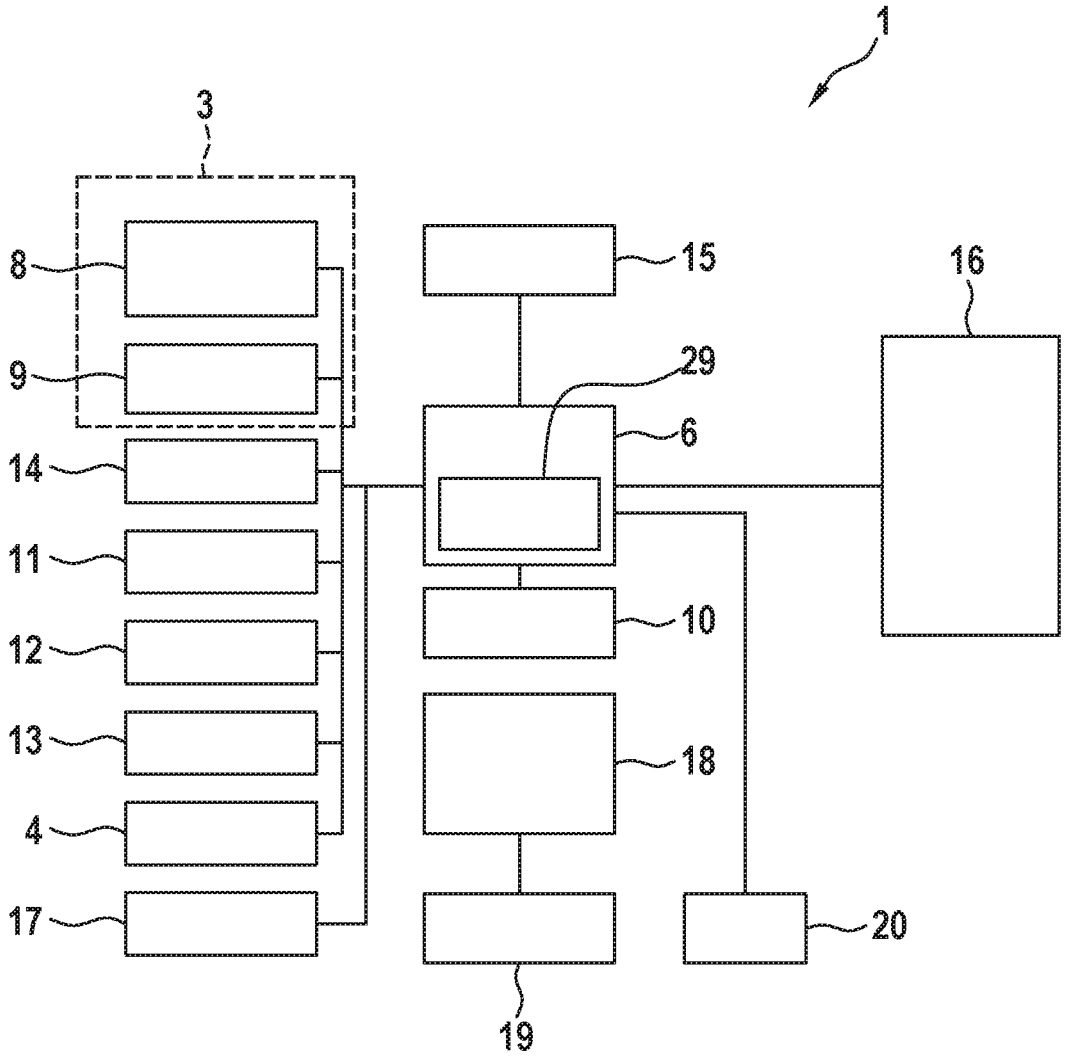
FIG. 3 is a schematic drawing of the fire-control device in accordance with the embodiment of the invention.

FIG. 3 schematically shows the fire-control device 1 in accordance with the embodiment of the invention. The fire-control device 1 comprises an inertial sensor unit 3, the inertial sensor unit 3 having three acceleration sensors 8 and three rotation rate sensors 9, in particular three gyroscopes. Data can be transferred from the inertial sensor unit 3 to a computation device 6, the computation device 6 in particular having a navigation computer 29. A storage device 10, in which in particular physical parameters of projectiles are stored, is further connected to the computation device 6, the projectiles being fireable by the small arm 2. By way of a user input device 15, also connected to the computation device 6, the marksman 22 can activate inputs to the fire-control device 1. In particular, the user input device is a push-button. A display device 16 and a data interface 20 are further connected to the computation device 6.

The fire-control device 1 can be electrically powered by way of a power supply 18. For this purpose, a battery pack 19 is advantageously provided, by way of which the electrical power can be dispensed.

The fire-control device 1 further has a brightness sensor 17 as well as an air pressure sensor 11, an air humidity sensor 12 and a temperature sensor 13. Finally, the fire-control device 1 has three magnetic field sensors 14. All of these sensors are connected to the computation device 6, in such a way that data from all of these sensors are available to the computation device 6.

It is provided that during sighting of the target 5 the position of the marksman 22, which is assumed to be the position of the small arm 2, and the bearing of the small arm 2 are initialised in the navigation computer 29 and the position of the target 5 relative to the marksman 22 is stored. At the same time, the navigation calculation of the navigation computer 29 is started. This may in particular involve the use of a strapdown algorithm, in which the measured angle increments from the rotation rate sensors 9 are integrated so as to update the current bearing of the small arm 2 and thus of the marksman 22. The speed increments of the acceleration sensors are advantageously used to calculate the change in position 7. The measurement data from the magnetic field sensors 14 may optionally additionally be used to determine the orientation. Advantageously, the data from the magnetic field sensors 14 are ignored if they contradict the data from the inertial sensor unit 3. Magnetic interference with the fire-control device 1 is thus not possible.

The navigation computer 29 thus knows the current position and the current bearing of the small arm 2, even when the marksman 22 makes the change in position 7. The current position and bearing are thus also available to the computation device 6. It is therefore possible for the marksman 22 to seek protection behind cover 21, the change in position 7 required for this purpose being detectable by the fire-control device 1.

Particularly advantageously, it is provided that the navigation computer 29 recalculates its own position at short intervals, in such a way that it is also always possible to calculate a current direction to the target 5 and a current distance 27 from the target 5. Thus, current target elevation angles and target azimuth angles can be determined, at which the marksman 22 has to orientate the small arm 2 so as to be able to hit the target 5 optimally.

The brightness sensor 17 serves to control the brightness of the display device 16 as a function of the ambient brightness, in such a way that the marksman 22 is not dazzled and also that as little light as possible, which might give away the position of the marksman 22, is generated.

Figure 4:
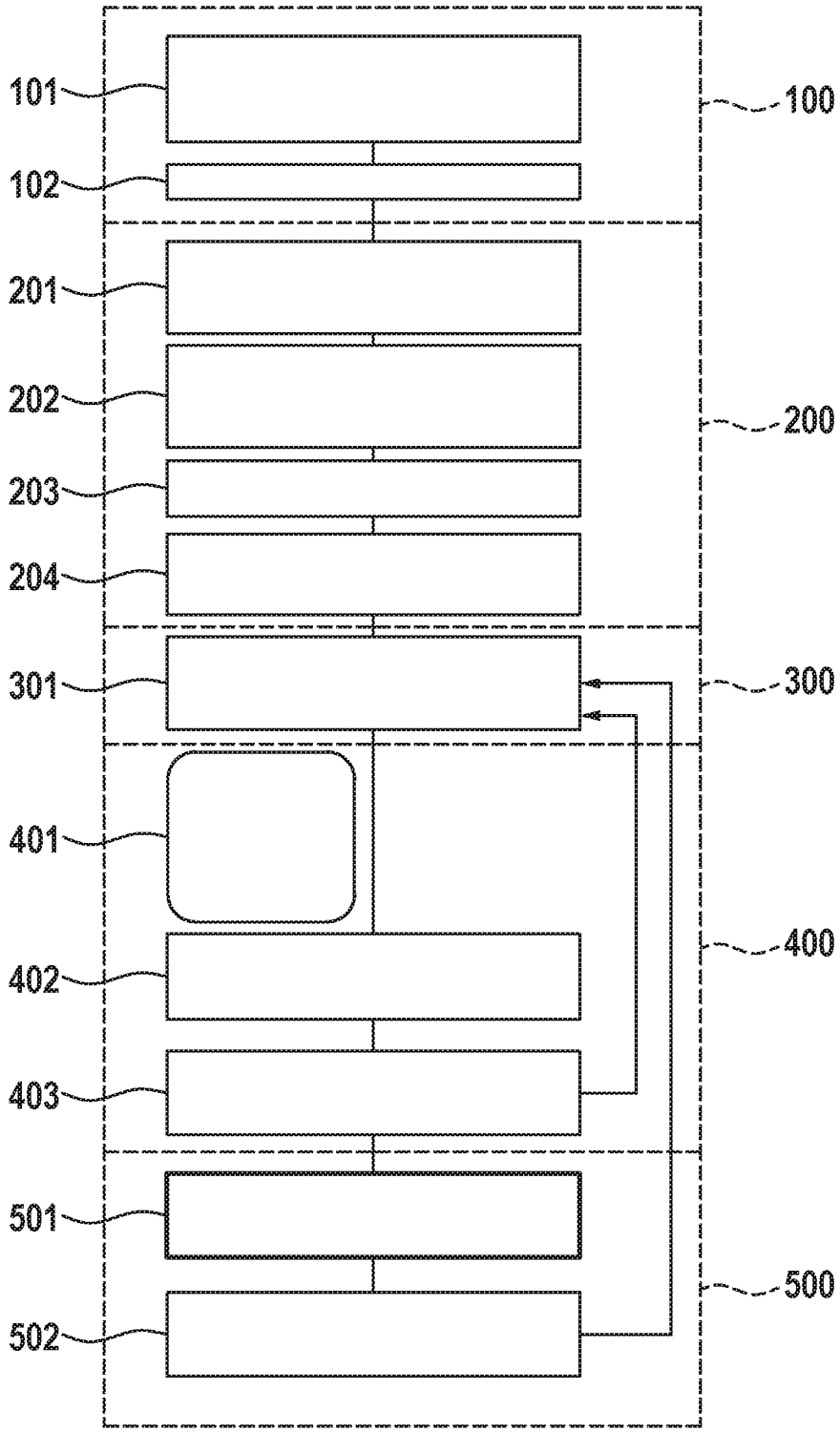
FIG. 4 is a schematic drawing of a sequence for hitting a target using the fire-control device in accordance with the embodiments of the invention.

Referring to FIG. 4, it is shown by way of example how the inventive fire-control device 1 according to the embodiment can be used. The functional sequence is divided into five phases. A first phase 100 corresponds to acquiring a target. This is followed by the second phase 200 of internal data processing and trajectory calculation. As a third phase 300, the small arm 2 is optimally orientated. In the fourth phase 400, there is a movement by the marksman 22, the marksman 22 in particular making the change in position 7. As a fifth phase 500, the shot is fired, the marksman 22 being able to reload the small arm 2 so as to fire a further shot at the target 5.

In the first phase 100, a target is acquired 101 using a sight 28. For this purpose, the marksman 22 may either use an available sight of the small arm 2 or a special sight 28 of the fire-control device 1. The marksman 22 orientates the small arm 2 towards the target 5 conventionally and activates the user input device 15, which is in particular a push-button. This push-button is advantageously wired to the computation device 6. By activating the user input device 15, the marksman starts the target calibration 102.

After the first phase 100 is complete, it is followed by the second phase 200. In the second phase, the distance 27 from the target 5 is determined by means of the distance sensor 4. By means of the inertial sensor unit 3, an orientation with respect to the target 5 can be detected. Advantageously, this orientation is additionally calculated by the magnetic field sensors 14. Subsequently, the measured values are read 201 by the computation device 6. The computation device 6 can therefore determine a firing angle, at which the small arm 2 has to fire a shot, from the data read out. This includes determining 202 the target distance, the direction relative to the target and the height difference to the target. The trajectory 23 and hence the firing angle can be determined from these data. The firing angle thus forms a basis for determining the elevation angle 24 and azimuth angle 30, 31 which the small arm 2 has to take on so as to be able to hit the target 5. In a further step, the navigation is started 203 in the navigation computer. On the basis of the navigation, the trajectory to the target is calculated 204 and the optimum firing angle is determined. In this context, it is provided that, as long as the marksman 22 holds down the push-button of the user input device 15 and tracks the target, the changes in elevation, azimuth and distance are detected by the computation device 6. Thus, the computation device 6 can determine an assumed movement of the target 5 from these changes.

Moreover, current values for air temperature, air pressure and air humidity are read from the air pressure sensor 11, the air humidity sensor 12 and the temperature sensor 13. Together with the parameters of the projectiles of the small arm 2 which are stored in the storage device 10, the target elevation angle can thus be calculated by the computation device 6. The target azimuth angle is initially taken from the measurement.

The distance 27 from the target 5 can thus be displayed in the display device 16. Likewise, the assumed movement of the target 5 can be shown in the display device 16. Finally, it is preferably provided that the target azimuth angle and the target elevation angle can be displayed in the display device 16.

The aforementioned values are displayed 301 within the third phase 300. The third phase 300 thus represents a fall-back position, to which it is possible to fall back from the fourth phase 400 and from the fifth phase 500, since the display of the aforementioned values is to be updated when the distance 27 changes.

In the fourth phase 400, the marksman 22 makes a change in movement 401. Thus, the inertial sensor unit 3 is subsequently read 402 by the computation device 6, in particular by the navigation computer 29. The navigation computer 29 can therefore determine a new target distance and a new target direction. Subsequently, the trajectory 23 is recalculated 403, as well as the target azimuth angle and the target elevation angle. This is followed by falling back to the third phase 300, in such a way that the newly calculated values are displayed 301 in the display device 16.

The marksman 22 may make a change in position 7 in particular so as to change to a better protected position. The navigation computer 29 thus integrates all of the movements made after the end of the second phase 200 so as continuously to update the position of the small arm 2 and thus of the marksman 22. The new position of the marksman 22 and of the small arm 2 is thus used as a basis for the line of fire which is newly to be calculated.

In the fifth phase 500, the shot is fired 501. Optionally, the marksman 22 may reload 502 the small arm 2, it being possible to hit the target 5 again. For this purpose, there is a fall-back to the third phase 300 again, in such a way that the values relevant for hitting the target 5 are displayed 301 in the display device 16.

Preferably, error estimation is also carried out. For this purpose, the computation device 6 regularly carries out a current imprecision estimation on the basis of the precision class of the inertial sensors used and the movements measured by these sensors. If the imprecision exceeds an internally predetermined value, the marksman is informed of this by way of the display device 16.

The display device 16 thus displays at least a current distance to the target 5 and/or a target azimuth angle and/or a target elevation angle and/or a target deflection angle to the marksman on the basis of the assumed movement of the target 5. Thus, comprehensive information is available to the marksman, and is received by the marksman 22 even if he changes position. This ensures that it is possible to hit the target 5 reliably, whilst at the same time making it possible for the marksman 22 to seek a safe location.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

What is claimed is:

1. A fire-control device for a small arm, comprising:

an inertial sensor unit for six degrees of freedom;

a distance sensor configured to determine a distance to a target sighted via a sight;

a user-input device comprising a push-button; and a computation device configured to determine a target orientation of the small arm from the distance and from parameters, predefined in a storage unit of the computation device, of a projectile to be fired by the small arm, wherein the target orientation is an orientation of the small arm in which the small arm is able to hit the target, wherein the target orientation comprises a target elevation angel, wherein the computation device is configured to determine the target elevation angle of the small arm from the distance and from parameters, predefined in the storage unit, of a projectile to be fired by the small arm, and wherein, after a change in position of the small arm, the computation device is configured to correct for the distance and the target elevation angle using data from the inertial sensor unit, and wherein the computation device is configured to detect a change in position of the small arm by way of the inertial sensor unit and to correct the target orientation using data from the inertial sensor unit, wherein the computation device is configured to determine the distance to the target after a user input, wherein the computation device detects changes in elevation and target azimuth angle of the small arm and distance to the target as long as the push-button is held by the user and determines an assumed movement of the target from these changes after the push-button is released, wherein the computation device is set up to determine the target azimuth angle of a current orientation of the small arm from data from the inertial sensor unit when the small arm is directed towards the target relative to an initialization position.

2. The fire-control device of claim 1 wherein the inertial sensor unit has three acceleration sensors and three rotation rate sensors.

3. The fire-control device of claim 1 wherein the computation device is configured to determine the target elevation angle from data from at least one of an air pressure sensor, an air humidity sensor, and a temperature sensor.

4. The fire-control device of claim 1 wherein the computation device is configured to determine a target azimuth angle from a current orientation of the small arm, which can be determined from data from the inertial sensor unit, and wherein, after a change in position or a change in the current orientation of the small arm, the computation device is configured to correct for the target azimuth angle using data from the inertial sensor unit.

5. The fire-control device of claim 4 wherein the computation device is configured to determine a current orientation of the small arm from data from at least one magnetic field sensor.

6. The fire-control device of claim 1 further comprising a user input device comprising a push-button, and wherein the computation device is configured to determine, after a user input, the distance to the sighted target using the distance sensor and an assumed movement of the target from a movement of the small arm determined from data from the inertial sensor device.

7. The fire-control device of claim 1 wherein the distance sensor is a laser sensor.

8. The fire-control device of claim 1 further comprising:

a display device configured to display at least one of the target orientation and a current deviation of the small arm from the target orientation.

9. A small arm, comprising:

a fire-control device comprising:

an inertial sensor unit for six degrees of freedom;

a distance sensor configured to determine a distance to a target sighted via a sight;

a user-input device comprising a push-button; and a computation device configured to determine a target orientation of the small arm from the distance and from parameters, predefined in a storage unit of the computation device, of a projectile to be fired by the small arm, wherein the target orientation is an orientation of the small arm in which the small arm is able to hit the target, wherein the target orientation comprises a target elevation angle, wherein the computation device is configured to determine the target elevation angle of the small arm from the distance and from parameters, predefined in the storage unit, of a projectile to be fired by the small arm, and wherein, after a change in position of the small arm, the computation device is configured to correct for the distance and the target elevation angle using data from the inertial sensor unit, and wherein the computation device is configured to detect a change in position of the small arm by way of the inertial sensor unit and to correct the target orientation using data from the inertial sensor unit, wherein the computation device is configured to determine the distance to the target after a user input, wherein the computation device detects changes in elevation and target azimuth angle of the small arm and distance to the target as long as the push-button is held by the user and determines an assumed movement of the target from these changes after the push-button is released, wherein the computation device is set up to determine the target azimuth angle of a current orientation of the small arm from data from the inertial sensor unit when the small arm is directed towards the target relative to an initialization position.

10. The fire-control device of claim 6 wherein the user input device is a push-button.

11. The fire-control device of claim 8 wherein the display device is configured to display at least one of the target elevation angle and the target azimuth angle and a current deviation of the small arm from the target azimuth angle and from the target elevation angle.

12. An assault rifle comprising:

at least one of an under-barrel grenade launcher, a portable grenade launcher, or a grenade gun, and a fire-control device comprising:

an inertial sensor unit for six degrees of freedom;

a distance sensor configured to determine a distance to a target sighted via a sight;

a user-input device comprising a push-button; and a computation device configured to determine a target orientation of the small arm from the distance and from parameters, predefined in a storage unit of the computation device, of a projectile to be fired by the small arm, wherein the target orientation is an orientation of the small arm in which the small arm is able to hit the target, wherein the target orientation comprises a target elevation angle, wherein the computation device is configured to determine target elevation angle of the small arm from the distance and from parameters, predefined in the storage unit, of a projectile to be fired by the small arm, and wherein, after a change in position of the small arm, the computation device is configured to correct for the distance and the target elevation angle using data from the inertial sensor unit, and wherein the computation device is configured to detect a change in position of the small arm by way of the inertial sensor unit and to correct the target orientation using data from the inertial sensor unit, wherein the computation device is configured to determine the distance to the target after a user input, wherein the computation device detects changes in elevation and target azimuth angle of the small arm and distance to the target as long as the push-button is held by the user and determines an assumed movement of the target from these changes after the push-button is released, wherein the computation device is set up to determine the target azimuth angle of a current orientation of the small arm from data from the inertial sensor unit when the small arm is directed towards the target relative to an initialization position.

13. The fire-control device of claim 1 wherein the small arm comprises a barrel and wherein the target elevation angle is an angle through which the barrel of the small arm has to be pivoted from the horizontal such that the projectile fireable from the small arm is able to hit the target in accordance with a ballistic trajectory.

14. The fire-control device of claim 13 wherein the barrel comprises a barrel axis passing centrally through the barrel of the small arm wherein the elevation angle is an angle between a line directly connecting the small arm to the target and the barrel axis.

* * * * *